US007419103B2

(12) United States Patent
Pauer

(10) Patent No.: US 7,419,103 B2
(45) Date of Patent: Sep. 2, 2008

(54) FUEL INJECTOR WITH DIRECT NEEDLE CONTROL FOR AN INTERNAL COMBUSTION ENGINE

(75) Inventor: Thomas Pauer, Freiberg (DE)

(73) Assignee: Robert Bosch GmbH, Stuttgart (DE)

( * ) Notice: Subject to any disclaimer, the term of this patent is extended or adjusted under 35 U.S.C. 154(b) by 264 days.

(21) Appl. No.: 11/344,099

(22) Filed: Feb. 1, 2006

(65) Prior Publication Data

US 2006/0169802 A1 Aug. 3, 2006

(30) Foreign Application Priority Data

Feb. 2, 2005 (DE) ..... 10 2005 004 738

(51) Int. Cl.
*F02M 47/02* (2006.01)
*B05B 1/30* (2006.01)
*B05B 1/08* (2006.01)

(52) U.S. Cl. ..... 239/88; 239/96; 239/584; 239/585.4; 239/102.2

(58) Field of Classification Search ..... 239/88–92, 239/102.1, 102.2, 95, 584, 533.8, 533.9, 239/443, 444; 251/129.06
See application file for complete search history.

(56) References Cited

U.S. PATENT DOCUMENTS 4,784,102 A * 11/1988 Igashira et al. ..... 123/447
6,079,636 A * 6/2000 Rembold et al. ..... 239/88
6,390,385 B1 * 5/2002 Hardy et al. ..... 239/102.2
6,766,965 B2 * 7/2004 D'Arrigo ..... 239/102.2
6,776,354 B2 * 8/2004 Cooke ..... 239/102.2

FOREIGN PATENT DOCUMENTS

DE 103 26 046 A1 12/2004
DE 103 47 769 A1 1/2005

* cited by examiner

*Primary Examiner*—Davis D Hwu
(74) *Attorney, Agent, or Firm*—Ronald E. Greigg

(57) ABSTRACT

A fuel injector with direct needle control has a nozzle needle guided in a nozzle body, and an actuator and a hydraulic pressure boosting unit that has an actuator pressure boosting piston connected to the actuator and a nozzle needle pressure boosting piston connected to the nozzle needle. The actuator pressure boosting piston and the nozzle needle pressure boosting piston both act on a coupler chamber. The nozzle needle pressure boosting piston contains a cylindrical chamber in which a control piston is axially guided, whose coupler chamber pressure surface is exposed to the coupler chamber and whose differential pressure chamber pressure surface is exposed to an inner differential pressure chamber contained in the cylindrical chamber. At its end oriented away from the coupler chamber, the nozzle needle pressure boosting piston is associated with an outer differential pressure chamber that communicates with the inner differential pressure chamber via a hydraulic connection.

14 Claims, 1 Drawing Sheet

FUEL INJECTOR WITH DIRECT NEEDLE CONTROL FOR AN INTERNAL COMBUSTION ENGINE

CROSS-REFERENCE TO RELATED APPLICATIONS

This application is based on German Patent Application 10 2005 004 738.6 filed on Feb. 2, 2005, upon which priority is claimed.

BACKGROUND OF THE INVENTION

1. Field of the Invention

The invention relates to a fuel injector with direct needle control for an internal combustion engine.

2. Description of the Prior Art

Fuel injectors with a so-called direct needle control are known. Fuel injectors of this kind function without a control valve interposed between an electrically controlled actuator and a nozzle needle. The transmission of force between the actuator and the nozzle needle is implemented by means of a pressure boosting unit. Suitable actuators for this are in particular piezoelectric actuators, which have a direct or inverse triggering depending on whether or not they are supplied with current in the closed state. With a direct triggering, the piezoelectric actuator is supplied with current in order to open the nozzle needle so that a linear expansion of the piezoelectric actuator, through a pushing motion, causes an opening of the injection nozzles, the motion being amplified by the pressure boosting unit. In the closed state, the piezoelectric actuator therefore has a shorter longitudinal span. With an inverse triggering, the piezoelectric actuator is supplied with current in the closed state of the nozzle needle so that when the piezoelectric actuator is in the elongated state, it holds the nozzle needle closed. When the piezoelectric actuator is triggered to initiate the injection process, it is switched into a currentless state so that a pulling motion of the piezoelectric actuator causes a pressure drop in a control chamber of the pressure boosting unit. This hydraulically boosts the stroke motion of the piezoelectric actuator for opening the nozzle needle.

In fuel injectors with direct needle control, in order to be able to open the injection nozzles directly by means of the actuator, the actuator must overcome a powerful closing force. The opening force that the actuator must exert results from the fact that the nozzle needle is pressed into its seat by system pressure (the pressure level in the high-pressure accumulator). Lifting the nozzle needle away from its seat can require forces of up to 400 Newton. In order to assure a sufficient fuel flow when the injection nozzles are completely open during an injection into the combustion chamber of an autoignition internal combustion engine, it is also necessary for the nozzle needle to execute a maximum stroke of several 100 μm. Although the integration of a hydraulic booster unit does permit one to vary the length-to-diameter ratio of the piezoelectric actuator, the size of the actuator—also referred to as actuator volume—remains essentially proportional to the opening force to be exerted and to the maximum nozzle needle stroke distance to be achieved.

DE 10326046 A1 has disclosed various embodiments of fuel injectors with direct needle control. To this end, the fuel injector has a nozzle needle, which is guided in a nozzle body and acts on a nozzle needle sealing seat, and also has a piezoelectric actuator and a hydraulic pressure boosting unit. The pressure boosting unit has a hydraulic coupler and/or control chamber operatively connected to an actuator pressure booster piston, which is connected to the actuator, and is also operatively connected to a nozzle needle pressure booster piston, which is connected to the nozzle needle.

OBJECT AND SUMMARY OF THE INVENTION

The object of the invention is to create a fuel injector with direct needle control and inverse triggering, which is simply designed and is able to function with a small overall size. In addition, the fuel injector should perform a two-stage boosting of the nozzle needle.

The object of the invention is attained with a fuel injector according to the invention in which a control piston, which is axially guided inside the nozzle needle pressure booster piston, makes it possible to produce a fuel injector with a compact, small size, which is able to achieve the required pressure boosting ratio for a two-stage boosting with a small number of moving parts.

Advantageous modifications of the invention are disclosed. A particularly simple design can be achieved if in a stop position of the control piston, the nozzle needle booster piston and the control piston jointly form a coupler chamber pressure surface facing into the coupler chamber; this surface, in relation to a third coupler chamber pressure surface embodied on the actuator pressure booster piston, constitutes a first pressure boosting ratio for a first boosting stage. In order to achieve the stop position of the control piston in the cylindrical chamber, it is useful to provide a stop surface against which the control piston is prestressed by means of a compression spring. The initiation of a second booster stage is implemented in that a pressure compensation occurs that is transmitted from the outer differential pressure chamber via the inner differential pressure chamber to the control piston and causes the control piston to assume a position in which it is lifted away from the stop surface so that the annular surface pointing from the nozzle needle pressure booster piston into the coupler chamber and functioning as an effective pressure surface, in relation to the pressure surface constituted by the actuator pressure booster piston facing into the coupler chamber, constitutes a second pressure boosting ratio that produces an opening stroke that goes beyond the stroke of the actuator. The fuel injector can be implemented in an advantageous manner from a production engineering standpoint because the actuator pressure booster piston and the nozzle needle pressure booster piston are guided in a guide sleeve. It is also advantageous if a plunger spring prestresses the actuator pressure booster piston in the direction opposite from the closing direction of the nozzle needle and if the plunger spring is supported against the guide sleeve.

BRIEF DESCRIPTION OF THE DRAWING

The invention will be better understood and further objects and advantages thereof will become more apparent from the ensuing detailed description of preferred embodiments, taken in conjunction with the single drawing FIGURE which shows a schematic longitudinal section through of a fuel injector according to the invention.

DESCRIPTION OF THE PREFERRED EMBODIMENTS

Figure 1:
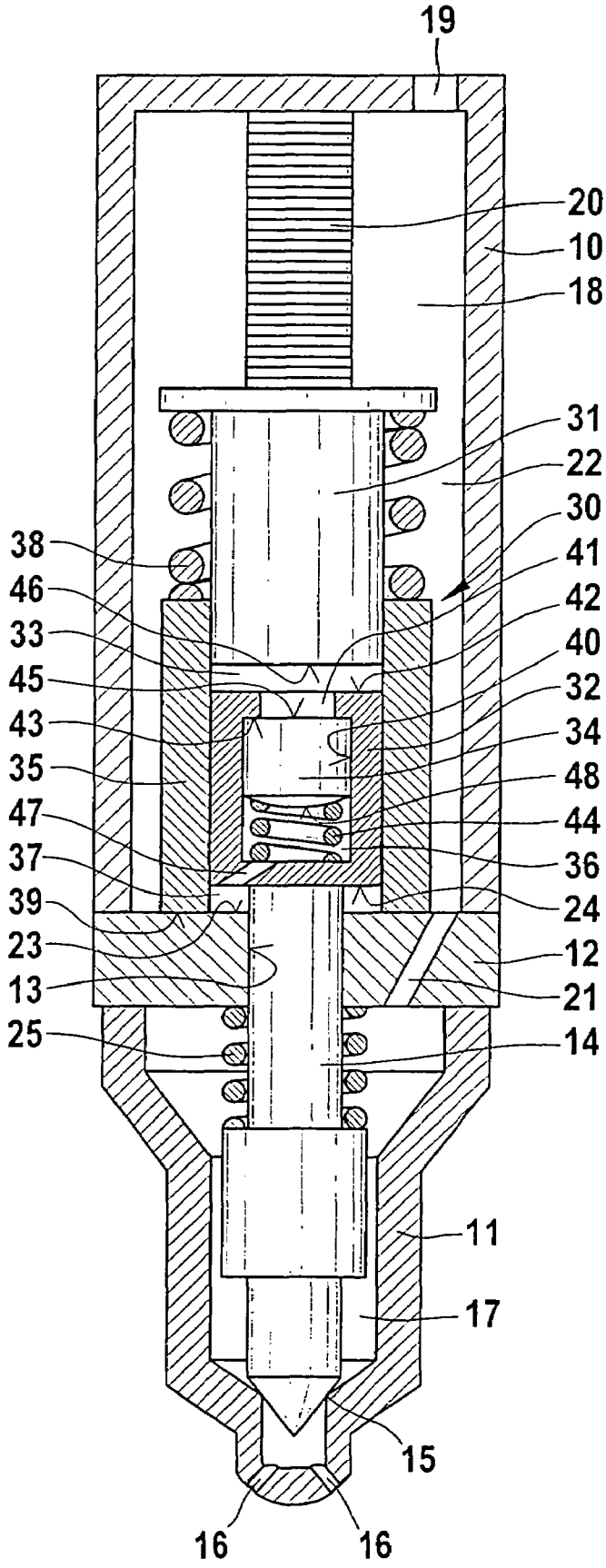

The fuel injector shown has an injector housing 10 with a nozzle body 11 whose lower end protrudes into a combustion chamber of an engine. Between the injector housing 10 and nozzle body 11, there is a nozzle needle guide 12 that contains a guide bore 13. A nozzle needle 14 is guided so that it can move axially in the guide bore 13. Between the tip of the nozzle needle 14 and the nozzle body 11, there is a sealing seat 15, downstream of which the nozzle body 11 contains injection nozzle openings 16 that protrude into the combustion chamber.

Upstream of the sealing seat 15, the nozzle body 11 contains a high-pressure chamber 17. In an upper region, the injector housing 10 contains an actuator chamber 18 to which a fuel inlet 19 is connected. The actuator chamber 18 contains a piezoelectric actuator 20. The fuel inlet 19 is connected to a high-pressure system, e.g. to a common rail system of a diesel injection apparatus. The nozzle needle guide 12 has a connecting bore 21 leading through it so that the fuel fed into the actuator chamber 18 via the fuel inlet 19 is conveyed at high pressure into the high-pressure chamber 17 associated with the nozzle needle 14.

In a lower region of the injector housing 10, the actuator chamber 18 transitions into a chamber 22 for a pressure boosting unit 30. The pressure boosting unit 30 has an actuator pressure boosting piston 31, a nozzle needle pressure boosting piston 32, a coupler chamber 33, a control piston 34, a guide sleeve 35, an inner differential pressure chamber 36, and an outer differential pressure chamber 37. The actuator pressure boosting piston 31 and the nozzle needle pressure boosting piston 32 are guided in the guide sleeve 35. Between the guide sleeve 35 and the actuator pressure boosting piston 31, there is a plunger spring 38 that presses a sealing surface 39 on the guide sleeve 35 against an end surface 23 on the nozzle needle guide 12. The plunger spring 38 also prestresses the actuator pressure boosting piston 31 against the piezoelectric actuator 20. In addition, a closing spring 25 acts on the nozzle needle 14, pushing it in the closing direction.

The nozzle needle pressure boosting piston 32 is provided with an inner cylindrical chamber 40 in which the control piston 34 is guided in an axially moving fashion. Toward the coupler chamber 33, the inner cylindrical chamber 40 is provided with a circular opening 41 so that the nozzle needle pressure boosting piston 32 has a first, annular coupler chamber pressure surface 42 oriented toward the coupler chamber 33. The diameter of the cylindrical chamber 40 is greater than the diameter of the opening 41, thus providing the control piston 34 with an annular stop surface 43 at the opening 41, which stop surface faces into the cylindrical chamber 40. The cylindrical chamber 40 and the control piston 34 are designed so that at its end oriented away from the coupler chamber 33, the control piston 34 in the cylindrical chamber 40 has a differential pressure chamber pressure surface 48 oriented into the inner differential pressure chamber 36. The inner differential pressure chamber 36 contains another compression spring 44 that presses the control piston 34 against the stop surface 43. In this stop position, the control piston 34 has a second, circular pressure surface 45 facing into the coupler chamber 40, which corresponds to the cross section of the opening 41. The actuator pressure booster piston 31 points into the coupler chamber 33 with a third coupler chamber pressure surface 46.

Toward the tip of the nozzle needle 14, the nozzle needle booster piston 32 is embodied as a stepped piston with an annular surface 24, which is associated with the outer differential pressure chamber 37 inside the guide sleeve 35. The outer differential pressure chamber 37 and the inner differential pressure chamber 36 are connected to each other by means of a hydraulic connection 47, for example a bore.

When the injection nozzle openings 16 are closed, the sealing seat 15 of the nozzle needle 14 is closed. The system pressure that the fuel inlet 19 delivers into the actuator chamber 18 and pressure chamber 17 is uniformly present in all pressure chambers. Leakage gaps are provided in the guide sleeve 35 so that the system pressure can travel into the coupler chamber 33 and into the outer differential pressure chamber 37 and, via the connection 47, into the inner differential pressure chamber 36. In this state, the pressure boosting unit 30 is pressure-balanced. Also in this state, the actuator 20 is supplied with a voltage and thus, in its powered state, is elongated in its vertical direction. The system pressure prevailing in the coupler chamber 33 acts on the nozzle needle pressure booster piston 32 in the closing direction so that in this state of the piezoelectric actuator 20, the sealing seat 15 of the nozzle needle 14 is closed.

If the voltage in the piezoelectric actuator 20 is reduced or if the piezoelectric actuator 20 is switched into the currentless state, then this also reduces the length of the piezoelectric actuator 20 in the vertical direction. The prestressing of the actuator pressure booster piston 31 in the direction of the piezoelectric actuator 20 by the plunger spring 38 causes the actuator pressure booster piston 31 to also move in the vertical direction due to the reduced vertical length of the piezoelectric actuator 20. This outward pulling action of the actuator pressure booster piston 31 in the guide sleeve 35 increases the volume in the coupler chamber 33, which causes a pressure reduction to occur therein, which yields an opening pressure $p_{o1}$ for a first stage in the opening of the nozzle needle 14. The pressure boosting for the first opening stage is a result of the ratio of the third coupler chamber pressure surface 46 embodied on the actuator pressure booster piston 31 to the overall coupler chamber pressure surface, the overall coupler chamber pressure surface being composed of the first, annular coupler chamber pressure surface 42 of the nozzle needle pressure booster piston 32 and the second, circular coupler chamber pressure surface 45 of the control piston 34. The stroke of the nozzle needle pressure booster piston 32 inside the guide sleeve 35 simultaneously reduces the pressure in the outer differential pressure chamber 37. This pressure reduction is transmitted via the connection 47 to the inner differential pressure chamber 36 so that the spring force of the compression spring 44 acting on the control piston 34 is overcome, as a result of which the control piston 34 lifts away from the stop surface 43. In the position in which the control piston 34 is lifted away from the stop surface 43, the nozzle needle pressure booster piston 32, along with only the first, annular coupler chamber pressure surface 42—which is comprised of the annular surface at the end, communicates as an effective pressure surface with the coupler chamber 33. Because of the reduced effective pressure surface on the nozzle needle pressure booster piston 32, a second pressure boosting stage is initiated that produces an additional stroke in comparison to the stroke of the piezoelectric actuator 20 and of the actuator pressure booster piston 32.

The supplying of current to the piezoelectric actuator 20 initiates an additional elongation of the piezoelectric actuator 20, which, transmitted by the actuator pressure booster piston 31, generates a pressure increase in the coupler chamber 33, which causes the nozzle needle 14 to close. The closing spring 25 acting on the nozzle needle 14 keeps the injection nozzles 16 closed in the inoperative state.

The foregoing relates to preferred exemplary embodiments of the invention, it being understood that other variants and embodiments thereof are possible within the spirit and scope of the invention, the latter being defined by the appended claims.

I claim:

1. A fuel injector for an internal combustion engine, having a nozzle needle that is guided in a nozzle body and acts on a nozzle needle sealing seat, and having a piezoelectric actuator and a hydraulic pressure boosting unit that has an actuator pressure boosting piston connected to the actuator and a nozzle needle pressure boosting piston connected to the nozzle needle, both of which pistons act on a coupler chamber located between the actuator pressure boosting piston and the nozzle needle pressure boosting piston and, depending on the pressure in the coupler chamber, the nozzle needle is lifted away from the nozzle needle sealing seat and thus highly pressurized fuel is injected from a high-pressure chamber into a combustion chamber of the engine, the improvement wherein the nozzle needle pressure boosting piston comprises a cylindrical chamber, a control piston axially guided in the cylindrical chamber and having a coupler chamber pressure surface exposed to the coupler chamber and having a differential pressure chamber pressure surface exposed to an inner differential pressure chamber contained in the cylindrical chamber, and the nozzle needle pressure boosting piston being associated with an outer differential pressure chamber that communicates via a hydraulic connection with the inner differential pressure chamber acting on the control piston.

2. The fuel injector according to claim 1, wherein at the end oriented away from the coupler chamber, the outer differential pressure chamber is associated with the nozzle needle pressure boosting piston.

3. The fuel injector according to claim 1, further comprising a guide sleeve, the actuator pressure booster piston and the nozzle needle pressure booster piston being guided in the guide sleeve.

4. The fuel injector according to claim 3, further comprising a plunger spring prestressing the actuator pressure booster piston in the direction opposite from the closing direction of the nozzle needle, the plunger spring being supported against the guide sleeve.

5. A fuel injector for an internal combustion engine, having a nozzle needle that is guided in a nozzle body and acts on a nozzle needle sealing seat, and having a piezoelectric actuator and a hydraulic pressure boosting unit that has an actuator pressure boosting piston connected to the actuator and a nozzle needle pressure boosting piston connected to the nozzle needle, both of which pistons act on a coupler chamber and, depending on the pressure in the coupler chamber, the nozzle needle is lifted away from the nozzle needle sealing seat and thus highly pressurized fuel is injected from a high-pressure chamber into a combustion chamber of the engine, the improvement wherein the nozzle needle pressure boosting piston comprises a cylindrical chamber, a control piston axially guided in the cylindrical chamber and having a coupler chamber pressure surface exposed to the coupler chamber and having a differential pressure chamber pressure surface exposed to an inner differential pressure chamber contained in the cylindrical chamber, and the nozzle needle pressure boosting piston being associated with an outer differential pressure chamber that communicates via a hydraulic connection with the inner differential pressure chamber acting on the control piston, wherein, in a stop position of the control piston, the nozzle needle pressure booster piston and the control piston jointly form a coupler chamber pressure surface facing into the coupler chamber, which pressure surface, together with a third coupler chamber pressure surface embodied on the actuator pressure booster piston and points into the coupler chamber, constitutes a first pressure boosting ratio for a first boosting stage.

6. The fuel injector according to claim 5, further comprising a stop surface establishing the stop position of the control piston in the cylindrical chamber.

7. The fuel injector according to claim 6, further comprising a compression spring prestressing the control piston against the stop surface.

8. The fuel injector according to claim 7, wherein, in a position in which the control piston is lifted away from the stop surface, the first, annular coupler chamber pressure surface pointing from the nozzle needle pressure booster piston into the coupler chamber, in relation to the third coupler chamber pressure surface constituted by the actuator pressure booster piston facing into the coupler chamber, constitutes a second pressure boosting ratio that produces an opening stroke that goes beyond the stroke of the actuator, for a second boosting stage.

9. The fuel injector according to claim 6, wherein, in a position in which the control piston is lifted away from the stop surface, the first, annular coupler chamber pressure surface pointing from the nozzle needle pressure booster piston into the coupler chamber, in relation to the third coupler chamber pressure surface constituted by the actuator pressure booster piston facing into the coupler chamber, constitutes a second pressure boosting ratio that produces an opening stroke that goes beyond the stroke of the actuator, for a second boosting stage.

10. A fuel injector for an internal combustion engine, having a nozzle needle that is guided in a nozzle body and acts on a nozzle needle sealing seat, and having a piezoelectric actuator and a hydraulic pressure boosting unit that has an actuator pressure boosting piston connected to the actuator and a nozzle needle pressure boosting piston connected to the nozzle needle, both of which pistons act on a coupler chamber and, depending on the pressure in the coupler chamber, the nozzle needle is lifted away from the nozzle needle sealing seat and thus highly pressurized fuel is injected from a high-pressure chamber into a combustion chamber of the engine, the improvement wherein the nozzle needle pressure boosting piston comprises a cylindrical chamber, a control piston axially guided in the cylindrical chamber and having a coupler chamber pressure surface exposed to the coupler chamber and having a differential pressure chamber pressure surface exposed to an inner differential pressure chamber contained in the cylindrical chamber, and the nozzle needle pressure boosting piston being associated with an outer differential pressure chamber that communicates via a hydraulic connection with the inner differential pressure chamber acting on the control piston, wherein at the end oriented away from the coupler chamber, the outer differential pressure chamber is associated with the nozzle needle pressure boosting piston, and wherein, in a stop position of the control piston, the nozzle needle pressure booster piston and the control piston jointly form a coupler chamber pressure surface facing into the coupler chamber, which pressure surface, together with a third coupler chamber pressure surface embodied on the actuator pressure booster piston and points into the coupler chamber, constitutes a first pressure boosting ratio for a first boosting stage.

11. The fuel injector according to claim 10, further comprising a stop surface establishing the stop position of the control piston in the cylindrical chamber.

12. The fuel injector according to claim 11, further comprising a compression spring prestressing the control piston against the stop surface.

13. The fuel injector according to claim 12, wherein, in a position in which the control piston is lifted away from the stop surface, the first, annular coupler chamber pressure surface pointing from the nozzle needle pressure booster piston into the coupler chamber, in relation to the third coupler chamber pressure surface constituted by the actuator pressure booster piston facing into the coupler chamber, constitutes a second pressure boosting ratio that produces an opening stroke that goes beyond the stroke of the actuator, for a second boosting stage.

14. The fuel injector according to claim 11, wherein, in a position in which the control piston is lifted away from the stop surface, the first, annular coupler chamber pressure surface pointing from the nozzle needle pressure booster piston into the coupler chamber, in relation to the third coupler chamber pressure surface constituted by the actuator pressure booster piston facing into the coupler chamber, constitutes a second pressure boosting ratio that produces an opening stroke that goes beyond the stroke of the actuator, for a second boosting stage.

* * * * *